US006418681B1

(12) United States Patent
Dunks

(10) Patent No.: US 6,418,681 B1
(45) Date of Patent: Jul. 16, 2002

(54) MODULAR TEMPORARY BARRIER SYSTEM COMPRISING FOAM CORE PANELS WITH PEG-RECEIVING APERTURES ON THE SIDES AND U-SHAPED CONNECTOR RECEIVING PORTIONS ON THE TOP AND BOTTOM

(76) Inventor: James E. Dunks, 11158 Morning Creek Dr., San Diego, CA (US) 92128

( * ) Notice: Subject to any disclaimer, the term of this patent is extended or adjusted under 35 U.S.C. 154(b) by 0 days.

(21) Appl. No.: 09/667,206

(22) Filed: Sep. 21, 2000

(51) Int. Cl.[7] ..... E04B 2/00

(52) U.S. Cl. ..... 52/239; 52/585.1; 52/787.1; 52/745.13; 160/135

(58) Field of Search ..... 52/239, 243, 463, 52/745.09, 238.1, 241, 242, 465, 309.9, 582.1, 585.1, 787.1, 745.13; 160/377, 351, 135, 352, 236

(56) References Cited

U.S. PATENT DOCUMENTS

| | | | | |
|---|---|---|---|---|
| 662,376 A | | 11/1900 | Goehst | |
| 1,106,383 A | | 8/1914 | Holnagel | |
| 2,482,405 A | | 9/1949 | Edlund | |
| 2,777,172 A | | 1/1957 | Debbink | |
| 3,172,170 A | | 3/1965 | Webster | |
| 3,325,585 A | | 6/1967 | Brenneman | |
| 3,627,362 A | | 12/1971 | Brenneman | |
| 3,760,547 A | | 9/1973 | Brenneman | |
| 4,067,165 A | | 1/1978 | Timmons | |
| 4,163,348 A | * | 8/1979 | Thomas, Jr. | 52/241 |
| 4,192,113 A | * | 3/1980 | Martin, Jr. | 52/282 |
| 4,571,906 A | * | 2/1986 | Ashton | 52/239 |
| 5,007,222 A | | 4/1991 | Raymond | |
| 5,136,821 A | * | 8/1992 | Child | 52/144 |
| 5,152,113 A | * | 10/1992 | Guddas | 52/238.1 |
| 5,628,158 A | | 5/1997 | Porter | |
| 5,768,845 A | * | 6/1998 | Beaulieu et al. | 52/585.1 |

FOREIGN PATENT DOCUMENTS

| | | |
|---|---|---|
| IT | 423297 | 6/1947 |

* cited by examiner

*Primary Examiner*—Beth A. Stephan
*Assistant Examiner*—N. Slack
(74) *Attorney, Agent, or Firm*—Pillsbury Winthrop LLP

(57) ABSTRACT

A modular temporary barrier system includes a plurality of panel members having adjoining edges. Each panel member comprises a foam core and exterior sheathing disposed thereon. Connecting structure associated with the panels is constructed and arranged to removably connect adjoining edges of adjacent panel members to one another, such that connected panel members together form a wall. In preferred embodiments of the invention, each panel member and two one-piece corner members each comprise a foam core and exterior sheathing disposed thereon. Each corner member can be removably connected to a respective end of the wall. In other preferred embodiments of the invention, the modular barrier system can further include two side panel members, each side panel member being able to connect to a respective end of the wall such that the wall is self-supporting.

19 Claims, 8 Drawing Sheets

MODULAR TEMPORARY BARRIER SYSTEM COMPRISING FOAM CORE PANELS WITH PEG-RECEIVING APERTURES ON THE SIDES AND U-SHAPED CONNECTOR RECEIVING PORTIONS ON THE TOP AND BOTTOM

FIELD OF THE INVENTION

This invention relates generally to modular barrier systems for obstructing view of a selected area and, more specifically, to the erection of modular temporary barrier systems for obstructing view of a selected area.

BACKGROUND OF THE INVENTION

Typical conventional barrier systems including panel members connected together by wood or metal studs are erected for specific applications such as obstructing view of selected construction areas or reducing sound travel through the barrier system. For example, when building a new store or remodeling a pre-existing one within an indoor shopping mall, a conventional modular barrier system can be erected to substantially cover the store-front region.

Conventional barrier systems are typically scrapped after only one use. In addition to being wasteful of resources, this makes them somewhat costly, despite use of inexpensive materials. This also means that for each use, new material must be transported to the site. In a shopping mall, where several construction projects may go on over time, it is wasteful to bring new materials for each project.

In some conventional systems, plywood-sheeting panels are nailed to frames made from wood or metal studs to erect such barrier systems. However, plywood panels do not have an appealing aesthetic appearance and sound can travel through plywood barrier systems relatively easily, which can disrupt shoppers on the other side of the plywood barrier system. In addition, plywood is a heavy material making plywood barrier systems relatively expensive and less cost-effective. Moreover, these types of panels are not adapted for reuse.

In some instances, drywall panels have been used to erect barrier systems. These systems are generally framed on site, whereby the drywall panels are positioned spaced from one another and plaster and/or tape is used to fill the space between the drywall panels in order to make a relatively smooth surface. Typically, drywall panels can be connected together by wood or metal studs and cut to the desired size. However, this process can be extremely messy, as drywall installation generally requires plaster and tape at the seams between panels. Moreover, even when painted over, drywall seams may show, detracting from the aesthetic appeal of such barrier systems. In addition, the drywall material is relatively soft and vulnerable to damage. Further, drywall or plywood typically allow excessive levels of sound to travel through the barrier system, and are not adapted for reuse.

Fiber reinforced polyester (FRP board) has also been used to form panel members used in barrier systems. In these instances, edges of FRP board panels tend to conform to the wood or metal studs connecting them together, thus creating a FRP board barrier system having a wavy surface and low aesthetic appeal. The wavy surface of the FRP board makes it difficult to adhere or position decals such as the store name, store logo or any other form of advertisement on an exterior surface of the barrier system. FRP board barrier systems are also not well-adapted for reuse.

Consequently, there exists a need for a reusable modular barrier system that provides a relatively quieter, cleaner and more conducive shopping environment for consumers and, more specifically, a reusable modular barrier system that covers the store-front region of a store and is cost-effective and aesthetically appealing.

BRIEF SUMMARY OF THE INVENTION

An object of the present invention is to fulfill the need outlined above. In accordance with the principles of the present invention, this objective is achieved by providing a modular temporary barrier system which includes a plurality of panel members having adjoining edges. Each panel member comprises a foam core and exterior sheathing disposed thereon. Connecting structure associated with the panels is constructed and arranged to removably connect adjoining edges of adjacent panel members to one another.

In preferred embodiments of the invention, the modular barrier system includes a plurality of panel members having adjoining edges. Each panel member comprises a foam core and exterior sheathing disposed thereon. Connecting structure associated with the panels is constructed and arranged to removably connect adjoining edges of adjacent panel members to one another. The connected panel members together form a wall. Each of two corner members is constructed and arranged to be removably connected to a respective end of the wall.

In other preferred embodiments of the invention, the modular barrier system further includes two side panel members. Each side panel member is connected to a respective end of the wall such that the wall is self-supporting.

Other objects, features, and advantages of the present invention will become apparent from the following detailed description, the accompanying drawings, and the appended claims.

DETAILED DESCRIPTION OF THE INVENTION

Figure 1:
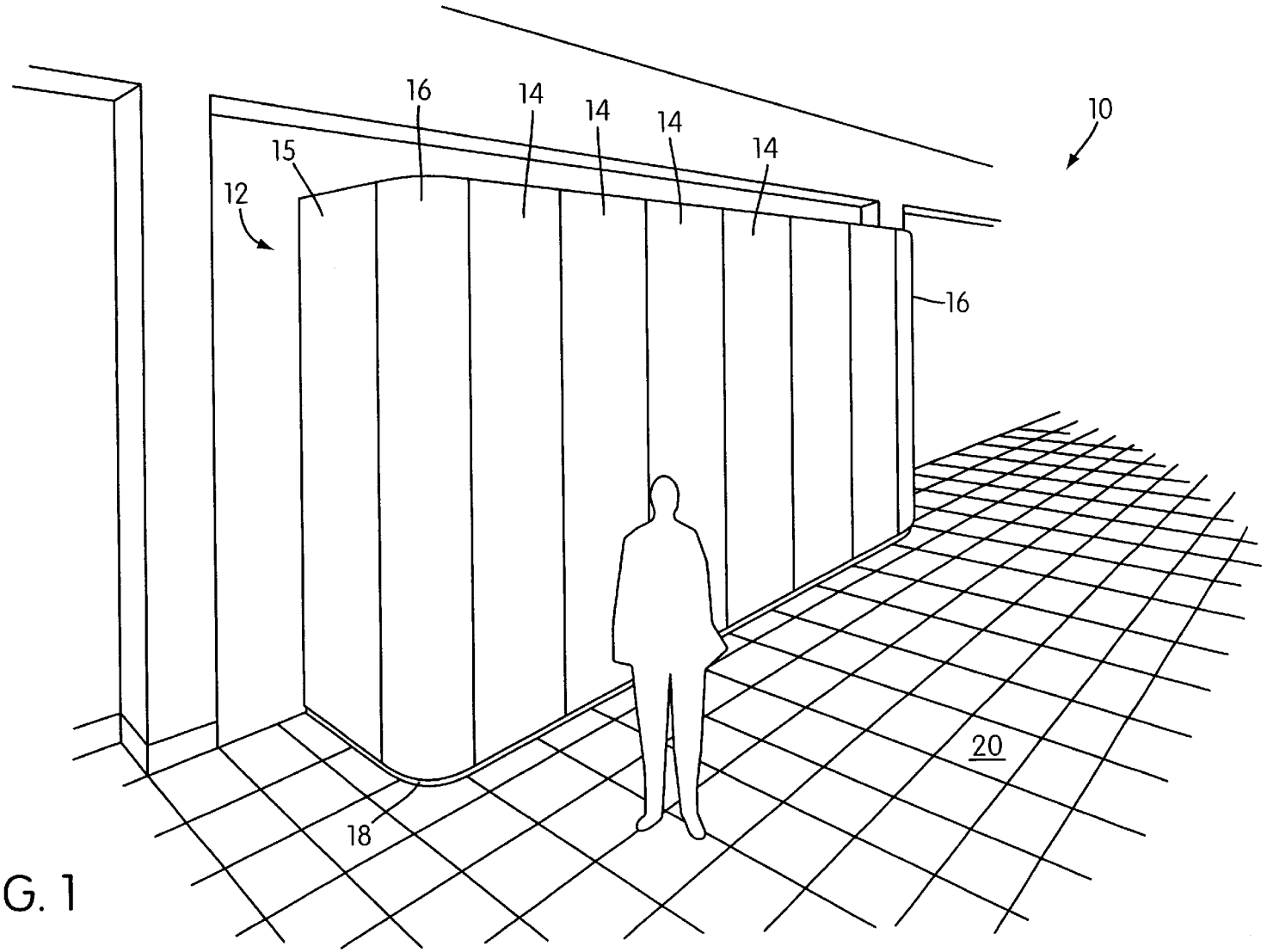
FIG. 1 is a perspective view of a modular temporary barrier system according to the present invention.

Referring now more particularly to the drawings, FIG. 1 illustrates a modular temporary barrier system ("barrier system") according to the invention. As illustrated, the barrier system, generally indicated at 10, is erected over the store-front region 12 of a store or shop which is being constructed or remodeled within an indoor shopping mall. The barrier system 10 substantially covers the store-front region 12 and is on the order of 10 to 15 feet high. The barrier system 10 extends approximately 2-6 feet from the store-front region 12 and into the hallway of the shopping mall.

The barrier system 10 is constructed from a plurality of flat panel members 14, two side panel members 15, and two (or more, depending on the specific location and desired configuration of the barrier system 10) of curved corner panel members 16. The various panel members 14, 15, 16 are connected together (as described in greater detail below) and supported by base member 18, which rests on the floor 20 of the mall.

Figure 2:
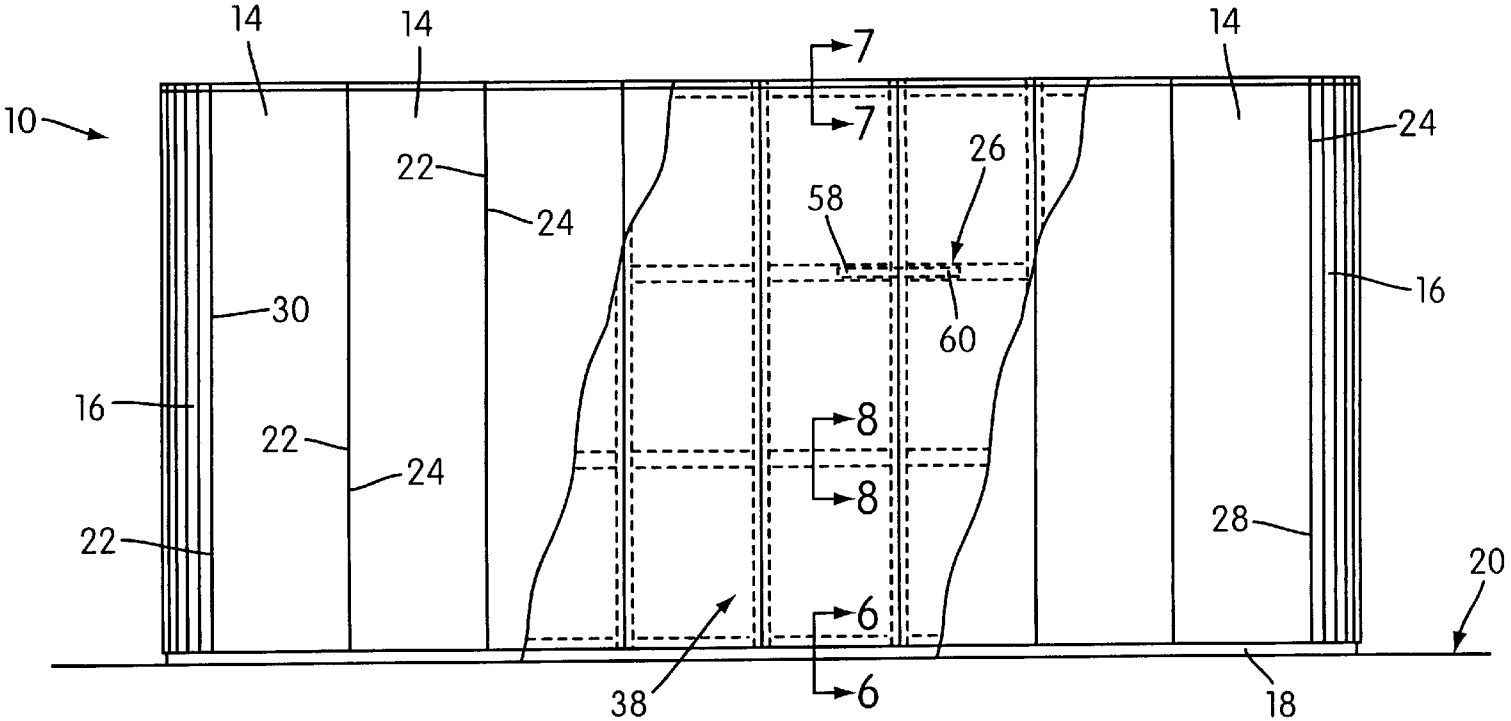
FIG. 2 is front view of the modular temporary barrier system shown in FIG. 1 with certain portions broken away to show the connecting structure thereof.
Figure 3:
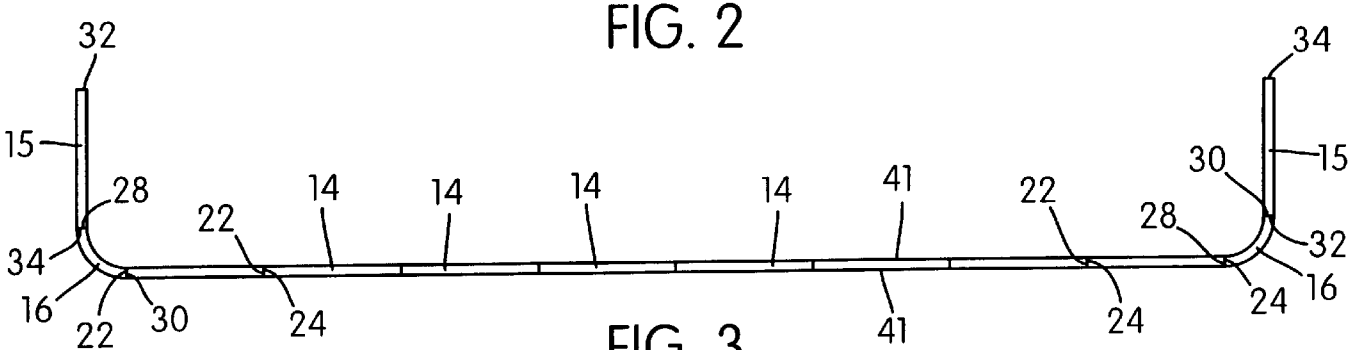
FIG. 3 is a top plan view of the modular temporary barrier system shown in FIG. 1.

As shown in FIGS. 2 and 3, a plurality of panel members 14 are disposed within the same plane, whereby the plurality of panel members 14 are removably connected at their adjoining edges 22, 24, respectively by a plurality of connecting members 26 to form a wall. As illustrated, the panel members 14 are precisely positioned and aligned relative to each other in all lateral directions about the horizontal axes of the connecting members 26. At the same time, relative lateral movement to either side is minimal by the close tolerance in those directions. It will be apparent to those skilled in the art that many other arrangements in addition to that shown in FIGS. 2 and 3 are possible using panel members, which can be removably connected together.

As best illustrated in FIGS. 2–5, each corner panel member 16 has adjoining edges 28, 30 removably connected to the edges 22, 24, respectively, of the outermost panel members 14 and to adjoining edges 32, 34 of the side panel members 15 by the connecting members 26. The edge 30 of the corner panel member 16 (shown on the left side of FIG. 3) is removably connected to the edge 22 of the leftmost panel member 14. The opposite edge 26 of that corner panel member is removably connected to the edge 34 of the side panel member 15. As illustrated, the side panel member 15 will be disposed at a general right angle relative to the plurality of panel members 14.

Similarly, the edge 28 of the corner panel member 16 (shown on the right side of FIG. 3) is removably connected to the edge 24 of the rightmost panel member 14. The opposite edge 30 of that corner panel member is removably connected to the edge 32 of the other edge panel member 15. As illustrated, the side panel member 15 will be disposed at a general right angle relative to the plurality of panel members 14. With the two side panels 15 disposed at general right angles relative to the plurality of panel members 14, the barrier system 10 is self-supporting.

Each connecting member 26 in the form of a rectangular peg, or spline is preferably of solid rectangular configuration and made of plywood, which is strong yet resilient. Each connecting member 26 is received within each of the oppositely facing apertures 40 mounted within adjacent panel; members 14, 15, 16 such that a first end 58 thereof is received within the aperture 40 within a first of the panel members 14, 15, 16 to be joined. The other end 60 thereof is received within the aperture 40 within a second of the panel members 14 being joined. Each connecting member 26 is configured and positioned to hold any two adjoining panel members 14, 15, 16 together with a friction interference fit having a desired amount of friction force, which must be overcome in order to separate the panel members 14, 15, 16. However, any other suitable removably connecting means may be implemented to hold the panel members 14, 15, 16 together.

The panel members 14, 15 have the same structure as the corner panel members 16 except that the corner panel members 16 are curved, whereas the panel members 14, 15 are flat. Since the panel members 14, 15, 16 are the same in construction and operation, a description of the panel member 14 will suffice to provide an understanding of all panel members.

Figure 6:
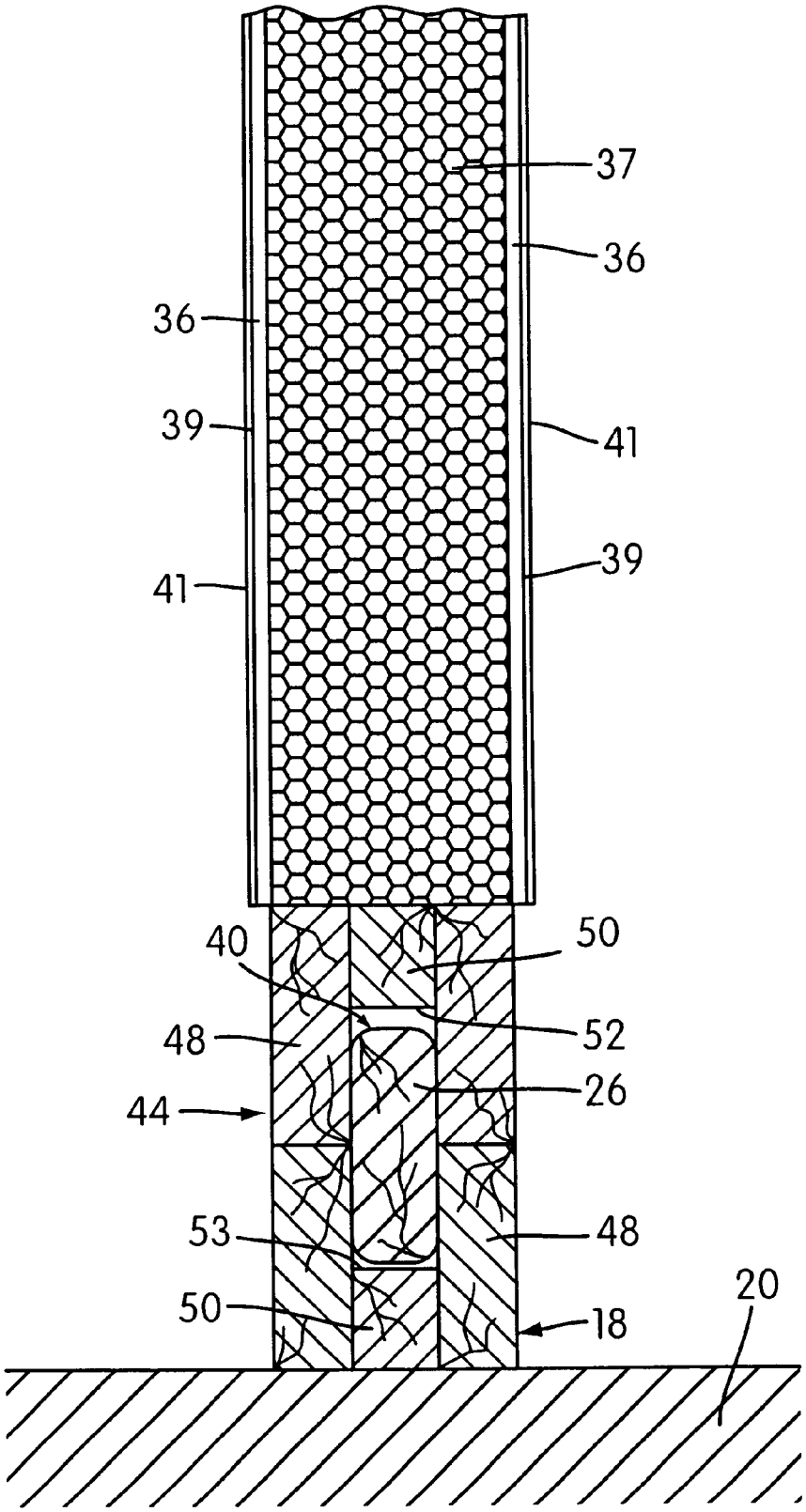
FIG. 6 is a cross sectional view taken along the line 6—6 of FIG. 2 showing a lower periphery of the modular temporary barrier system shown in FIG. 1.
Figure 7:
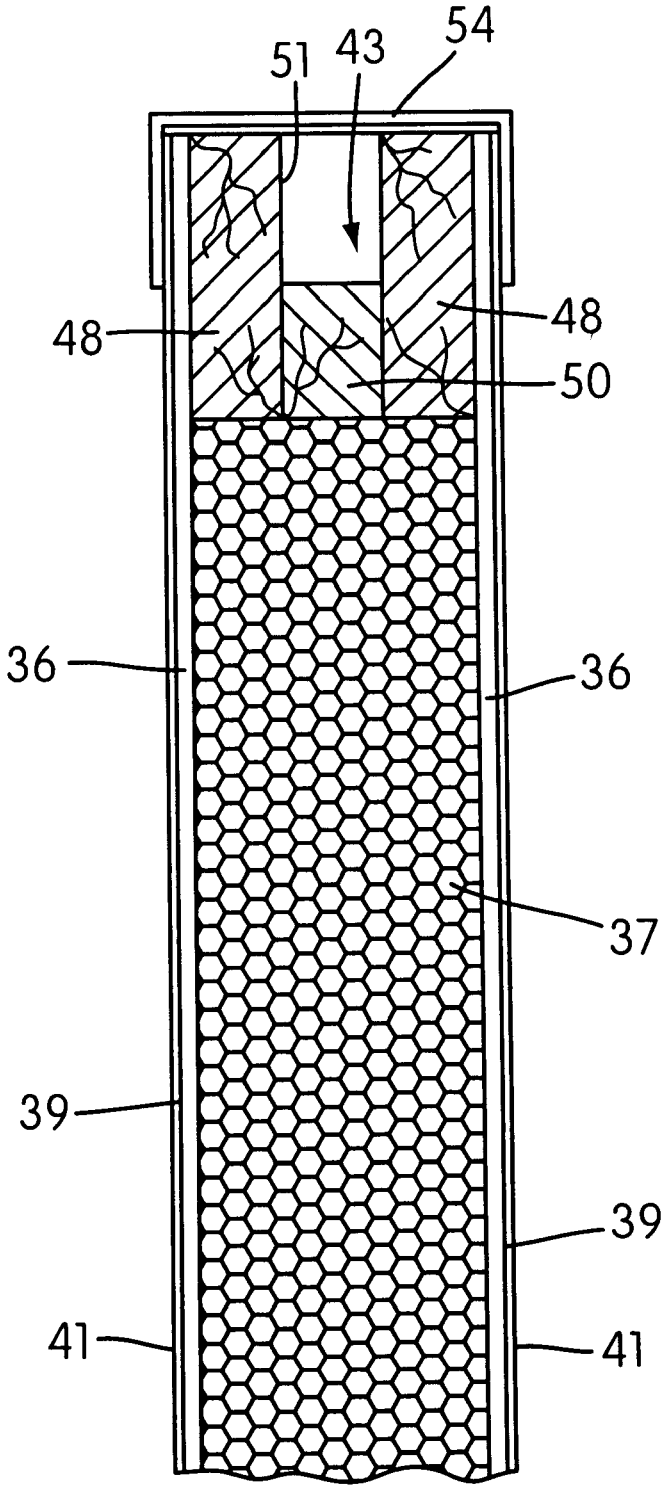
FIG. 7 is a cross sectional view taken along the line 7—7 of FIG. 2 showing an upper periphery of the modular temporary barrier system shown in FIG. 1.
Figure 8:
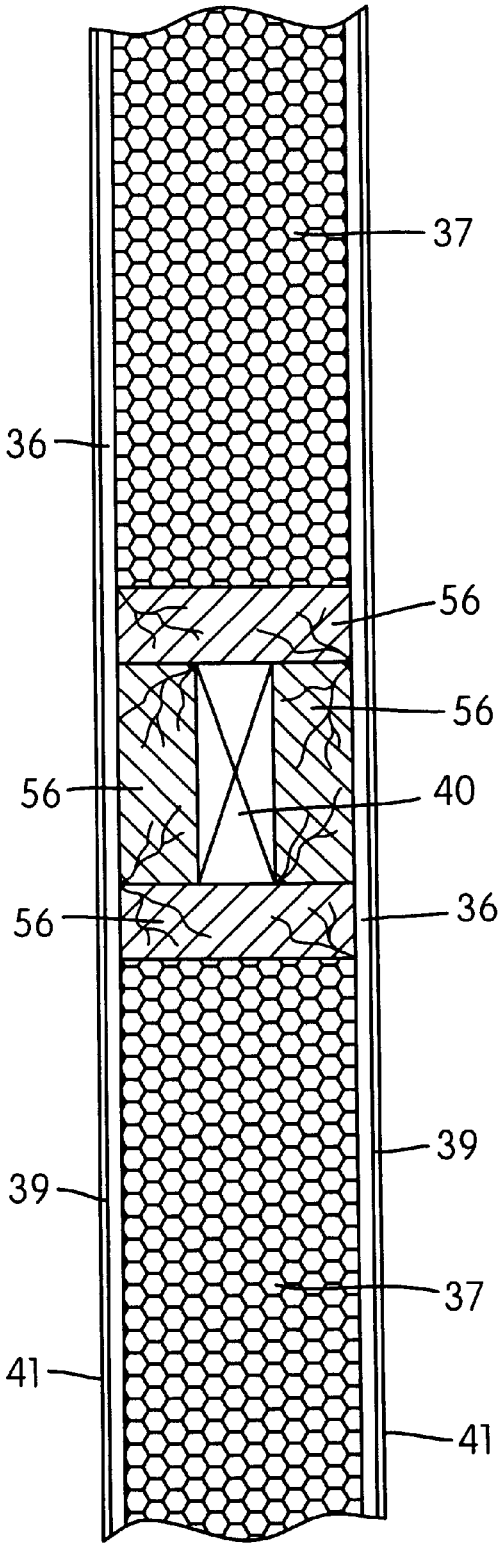
FIG. 8 is a cross sectional view taken along the line 8—8 of FIG. 2 showing a joint structure of the modular temporary barrier system shown in FIG. 1.

As best shown in FIGS. 6–8, one panel member 14 is formed of a pair of relatively thin, generally planar foam core panel components 36. The panel components 36 can be made from a thin, wood laminate material such as, for example, plywood veneer, and press fit together so as to capture an inner core of foam material 37 such as polystyrene therebetween. The foam material 37 provides additional strength to the panel components 36 and significantly reduces sound travel through the panel components 36.

Preferably, the foam material 37 is adhesively bonded to the panel components 36 by contact cement, glue or any other sufficient adhesive.

In a preferred embodiment, the foam material 37 is sandwiched between two ⅛" plywood veneer panels 36 and is secured with contact cement and 18 gauge staples. If desired, and most commonly for indoor uses, one or both of the plywood panels 36 may be replaced by a ⅛" layer of "mud", for example FOAM COAT® from Hamilton Materials, Inc. If mud is used, it is applied, allowed to dry and then may be painted.

Alternatively, the foam material 37 could be injected between the panel components 36 via a foam injection process.

A waterproof paper serves as an exterior sheathing 39 for the panel components 36 so as to give the front and rear faces 41 of the panel member 14 an attractive finished appearance. The panel member 14 may be colored, printed or otherwise decorated as desired on the front face or the rear face. Preferably, each panel member 14 has an attractive finished appearance on both faces 41 thereof so that the panel members 14 can be reversibly erected with either face 41 exposed for viewing, as for example facing a mall hallway.

The panel components 36 are spaced from one another by a connecting structure 38 disposed on each adjoining edge 22, 24 of the panel member 14, which defines a plurality of aligned apertures 40 extending through each panel member 14, 15, 16.

As illustrated, the connecting structure 38 includes a pair of thin, elongated edge frame members 42, a pair of top and bottom U-shaped portions 43, 44 and a pair of joint structures 46. The edge connecting structures 42 extend vertically along the sides of the panel member 14 and between the pair of panel components 36 to transversely space them from one another. The top and bottom U-shaped portions 43, 44 extend between the opposite ends of the edge frame members 42 along the upper and lower peripheries of the panel member 14 to define the basic size of the panel member 14. Preferably, the connecting structure 38 is press fit so as to remain secured together between the panel components 36. Additionally, fasteners such as staples secure the connecting structure 38 between the panel components 36. However, other types of fasteners such as nuts, screws, nails or any other suitable manner known in the art may also be used to do the same.

FIGS. 6 and 7 show the panel member 14 disposed vertically, wherein the top and bottom U-shaped portions 43, 44, for example of plywood, are disposed between the panel components 36. Specifically, the top U-shaped portion 43 has an open portion 51 facing upward and the bottom U-shaped portion 44 has an open portion 52 facing downward. Each U-shaped portion 43, 44 includes a pair of elongated end support members 48 positioned on opposite sides of a central support member 50 to define the respective open portions 51, 52 therebetween. Preferably, the support members 48, 50 are press fit so as to remain secured together between the panel components 36. Alternatively, the support members 48, 50 can be secured together by adhesives, fasteners such as nuts, screws, or nails and any suitable manner known in the art.

As best shown in FIG. 6, the base member 18 is formed of a relatively rigid material such as wood or steel to continuously extend across the floor 20 of the mall (or any other substantially flat surface). The base member 18 is formed from the supporting structures 48, 50 and arranged in the same configuration as in the top U-shaped portion 43. The supporting structures 48, 50 of the base member 18 form an open portion therein 53, which faces upwardly to correspond to the downwardly facing open portion 52 formed by the U-shaped portion 44 disposed on the lower periphery of the panel member 14. The oppositely facing pair of open portions 52, 53 cooperate to form one of the apertures 40. The aperture 40 receives a connecting member 26 so that the base member 18 can support the panel member 14.

As shown in FIG. 7, a protective cap 54 formed from a rugged material, for example of 20 gauge sheet metal, is configured into a generally U-shape so as to fit over the top U-shaped portion 43 and the panel components 36. The protective cap 54 extends transversely across the end support members 48 to cover the open portion 51 of the top U-shaped portion 43 along the upper periphery of the panel member 14 so that water, dirt or other possible harmful agents cannot penetrate the panel member 14.

Figure 4:
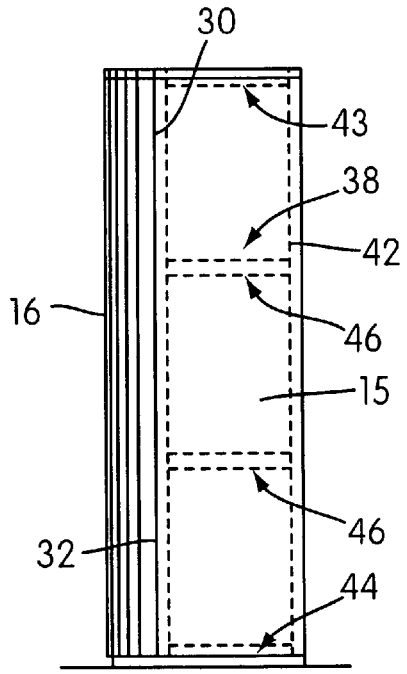
FIG. 4 is a right side view of the modular temporary barrier system shown in FIG. 1.
Figure 5:
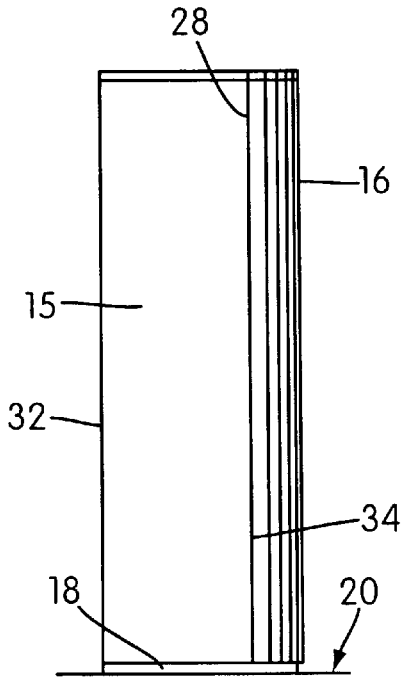
FIG. 5 is left side view of the modular temporary barrier system shown in FIG. 1.

FIGS. 2, 4 and 8 show the pair of joint structures 46, which trisect the foam material 37 by separating the adjacent foam core panel components 36. Each joint structure 46 includes a box extending between the two adjoining edges 22, 24 of the panel member 14. More specifically, the box comprises four substantially identical panel support members 56, preferably press fit together, extending through the panel member 14 from one edge 22 thereof to the other edge 24 thereof to define one of the apertures 40. The panel support members 56 are made of an appropriate hard material such as plywood or the like so that the panel components 36 remain rigid and of a fixed shape when receiving opposite ends 58, 60 of the connecting members 26.

Preferably, the individual panel members 14, 15, 16 can range from 60 inches to 144 inches in height, from 12 inches to 52 inches in width and are approximately 3 inches thick. The panel members 14, 15, 16 can be constructed in these various widths and heights so as to provide greater adaptability for substantially covering store-front regions having varying sizes. In unique circumstances, the panel members 14, 15, 16 may be constructed in any width, height or thickness depending on marketplace requirements.

OPERATION

The barrier system 10 may include any combination of the above described panel members 14, 15, 16. The panel members 14, 15, 16 are held together by the connecting members 26 in such a way that they are readily separated from one another but preferably upon the application of a predetermined amount of force. The connecting members 26 and apertures 40 advantageously complement one another to provide for relatively easy connecting and separation while at the same time providing a sturdy, rigid structure when any combination of the panel members 14, 15, 16 are removably connected in self-supporting relation to substantially cover the store-front region 12.

Laterally connecting the panel members 14, 15, 16 together is easily effected by starting the connecting members 26 into the apertures 40 of two adjacent panel members 14, 15, 16. Then, applying a force or striking one of the panel members 14, 15, 16 to drive the opposite ends of the connecting members 26 through the apertures 40 of the other panel member.

Alternatively, the connecting members could be integral with the panel members. In this alternative configuration, the connecting members would connect the panel members in essentially the same way as described above, except that only one end of the connecting member would be driven through the aperture of an adjacent panel because the other end would be integral with the panel member.

The panel members 14, 15, 16 may also be removably connected vertically so as to provide an extended height. To obtain the extended height, a vertical connecting member (not shown) is started into the open portion 52 of the bottom U-shaped portion 44 of a first panel member 14, 15, 16 and into the open portion 51 of the top U-shaped portion 43 of a second panel member 14, 15, 16. Then by applying a force or striking one of the panel members 14, 15, 16, the opposite ends of the vertical connecting member are driven into the open portions 51, 52 of the first and second panel members 14, 15, 16.

Preferably, the vertical connecting member is the same in construction as connecting members 26, but also could be any other configuration so as to removably connect the panel members 14, 15, 16 vertically so as to provide an extended height.

Separation is effected by applying the required force to one of the panel members 14, 15, 16 so as to overcome the friction force of the friction interference fitting of the connecting members 26. Once the friction force is overcome, the connecting members 26 can be pulled out of the apertures 40. As a practical matter, this can be accomplished by inserting the blade of a screw driver between the joined panel members or corner panel members and prying them apart to effect an initial separation. Then, a simple pulling motion on the panel members 14, 15, 16 while holding the other adjoined panel member 14, 15, 16 in place is usually sufficient to effect complete separation thereof.

Preferably, the panels are assembled in the above described manner to create a wall at least partially blocking a view of the construction area from customer trafficked areas of the shopping center. After the construction of that area ceases, the panel members could then be disassembled and stored at a location local to the shopping center. When another store within a shopping center undergoes construction and it is desired to partially block a view of the other construction area from customer trafficked areas of the shopping center, the panel members can be easily retrieved from their local location and reassembled to create the desired wall.

While the barrier system 10 is preferably assembled for use in indoor construction areas as described above, the principles of construction of the barrier system 10 can be embodied in any construction area. For example, the barrier system 10 may be assembled for use in a hotel where the construction area may either be an indoor and/or outdoor construction area.

While the principles of the invention have been made clear in the illustrative embodiments set forth above, it will be apparent to those skilled in the art that various modifications may be made to the structure, arrangement, proportion, elements, materials, and components used in the practice of the invention.

Figure 9:
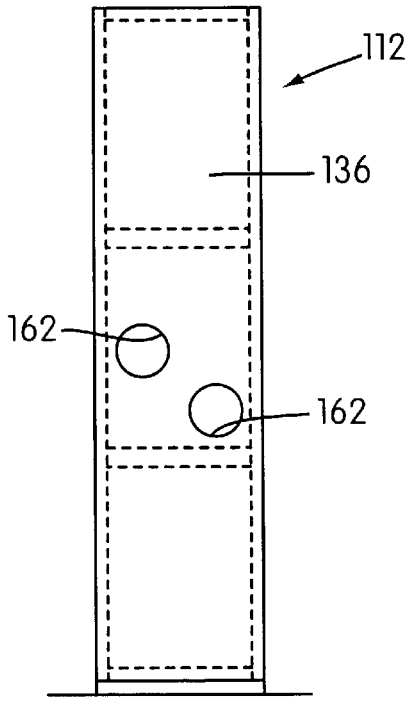
FIG. 9 is an alternative embodiment of the modular temporary barrier system shown in FIG. 1.

For example, FIG. 9 shows an alternative panel member 112, which allows viewing of a selected area such as a store being constructed or remodeled. The panel member 112 is identical in construction and operation as panel member 12, except that panel member 112 would be formed with a pair of ports 162 extending transversely through the panel components 136. The ports 162 would preferably be disposed in offset relation to one another.

Preferably, clear acrylic windows are disposed within the ports 162. That way, the clear acrylic windows would allow people of different heights to view through the ports 162 while precluding the people from reaching through the panel member 112.

The ports 162 may be annular having diameters of approximately 12 inches, however, it will be apparent to one skilled in the art that many other configurations and positions for ports 162 in addition to that shown in FIG. 9 are possible.

Figure 10:
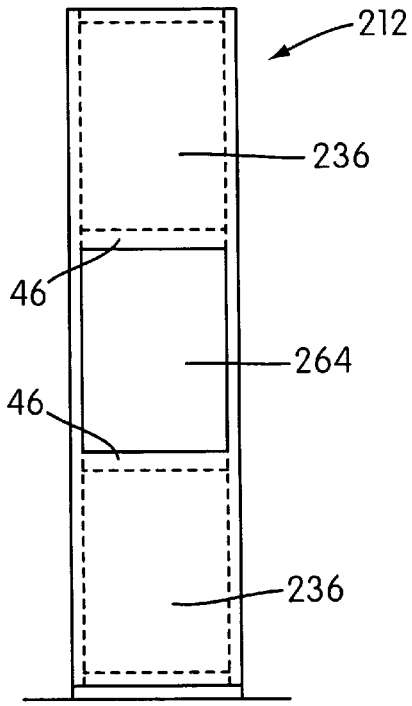
FIG. 10 is another alternative embodiment of the modular temporary barrier system shown in FIG. 1.

As shown in FIG. 10 shows panel member 214 as another alternative to the panel member 12. The panel member 214 would be identical in construction and operation as panel member 12, except that panel member 214 would include a display box 264 therein. The display box 264 would be positioned between the joint structures 46, which would separate the shortened panel components 236. The display box 264 would be pivotally attached to the panel member 214 by a hinge structure (not shown). For example, a series of aligned journaling members would extend from the panel member 214 and the display box 264. A pin-type axle member would pass through the journaling members and be retained therein by suitable securing means. That way, the display box 264 could be opened to allow items to be placed therein and then closed again to reform the barrier system. The display box 264 could also have a transparent portion (not shown) so that it could be used to display products therein while the store is being constructed or remodeled and potential consumers could view the products through the transparent portion of the display box.

Alternatively, the display box could also be positioned within an aperture (not shown) formed in the panel member by a friction interference fit. The display box could then be displaced from the aperture to allow items to be placed therein for display and then be replaced within the aperture to reform the barrier system.

Figure 11:
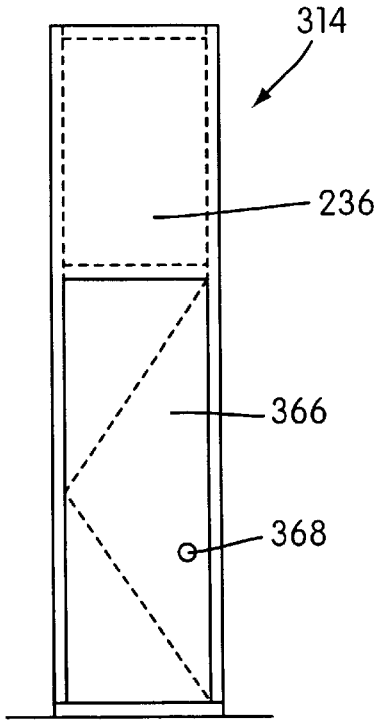
FIG. 11 is yet another alternative embodiment of the modular temporary barrier system shown in FIG. 1.

FIG. 11 shows panel member 314 as an another option to the panel member 12, wherein the panel member 314 would provide a door for passage through the barrier system. The panel member 314 would be identical in construction and operation as panel member 12, except that panel member 314 would include a door portion 366 having a manual engageable handle 368 extending therefrom. The panel component 236 would be displaced above the door portion 366. The door portion 366 of panel 314 would be pivotally attached to the panel member 314 by a hinge structure (not shown) such that the door portion 366 would open inwardly (opposite of the mall hallway) to become flush against an adjacent panel member. For example, the hinge structure could include a series of aligned journaling members extending from panel member 314 and the door portion 366. A pin-type axle member would pass through the journaling members and be retained therein by suitable securing means. With a hinge structure, the door portion 366 could be pivoted open to where it would be flush against an adjacent panel member to allow passage through the barrier system and then closed to reform the barrier system.

Figure 12:
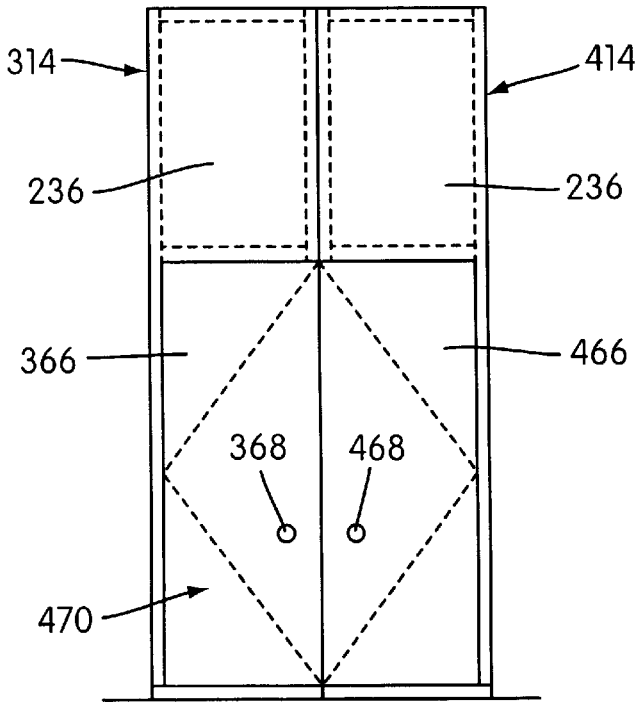
FIG. 12 is an alternative embodiment of the modular temporary barrier system shown in FIG. 11.

As shown in FIG. 12, a panel member 414 could supplement panel member 314 by providing an opposite door portion 466 having a manual engageable handle 468 extending therefrom and a panel component 236. The door portion 466 would be pivotally attached to the panel member 414 by the hinge structure described above to allow passage through the barrier system 10. The panel member 414 would be of mirror image construction and identical in operation to panel member 314 so as to cooperatively form a doorway portion 470 with the panel member 314. With the hinge structure described above, the door portions 366, 466 of doorway portion 470 could be pivoted open to so that they would be flush against panel members being adjacent thereto. Once opened, the doorway portion 470 would allow passage through the barrier system and the door portions 366, 466 of doorway portion 470 could then be closed to reform the barrier system.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

I claim:

1. A modular temporary barrier system, comprising:

a plurality of panel members, said panel members having adjoining edges, each panel member comprising a foam core and exterior sheathing disposed on opposite sides thereof; and connecting structure associated with said panels and constructed and arranged to removably connect said adjoining edges of adjacent panel members to one another, such that connected panel members together form a wall, wherein each of the panel members further comprises:

a top U-shaped portion being configured to receive said connecting structure and having an open portion facing upward when said panel member is disposed vertically; and a bottom U-shaped portion being configured to receive said connecting structure and having an open portion facing downward when said panel member is disposed vertically.

2. A modular temporary barrier system as in claim 1, further comprising:

two side panel members, each side panel member being constructed and arranged to be connected to a respective end of the wall, such that the wall is self-supporting.

3. A modular temporary barrier system as in claim 1, wherein the connecting structure comprises:

a plurality of pegs, each peg being constructed and arranged to be at least partially inserted into apertures disposed in adjoining edges of adjacent panel members to removably connect said adjacent panel members to one another, wherein the apertures extend laterally through each panel from one edge thereof to an opposite edge thereof.

4. A modular temporary barrier system as in claim 1, wherein the connecting structure removably connects adjacent panel members by friction interference fit.

5. A modular temporary barrier system as in claim 1, wherein each of the panel members further comprises:

a plurality of foam core panel components; and a joint structure, the joint structure separating adjacent foam core panel components, the joint structure comprising a box extending between the two adjoining edges of the panel and defining an aperture, wherein connecting structure associated with a panel is at least partially inserted into an aperture of an adjacent panel member to removably connect to said adjacent panel member by friction interference fit.

6. A modular temporary barrier system as in claim 1, wherein the barrier system further comprises a vertical connecting member constructed and arranged to removably connect a top U-shaped portion of a first panel member to a bottom U-shaped portion of a second panel member such that the first and second panel members are joined vertically to provide an extended height.

7. A modular temporary barrier system as in claim 1, further comprising a U-shaped base member, having an open portion facing upward such that said bottom U-shaped portion may be removably connected to the base member.

8. A modular temporary barrier system as in claim 1, further comprising a protective cap disposed covering the top U-shaped portion.

9. A modular temporary barrier system as in claim 1, further comprising two one-piece corner members, each corner member comprising an integrally formed, corner shaped foam core and exterior sheathing disposed on opposite sides thereof, each corner member being constructed and arranged to be removably connected to a respective end of the wall.

10. A modular temporary barrier system as in claim 9, wherein the connecting structure comprises connecting members.

11. A modular temporary barrier system as in claim 9, further comprising:

two side panel members, each side panel member being constructed and arranged to be connected to a respective end of the wall, such that the wall is self-supporting.

12. A modular temporary barrier system as in claim 11, wherein each corner member is constructed and arranged to connect a respective end of the wall to a respective side panel member.

13. A modular temporary barrier system as in claim 9, wherein the foam core comprises polystyrene and the exterior sheathing comprises a wood laminate material.

14. A method of using a barrier system in a construction area using a plurality of panel members having adjoining edges, each panel member comprising a foam core and exterior sheathing disposed thereon and connecting structure associated with the panels and being constructed and arranged to removably connect adjoining edges of adjacent panel members to one another, wherein each of the panel members further comprises a top U-shaped portion being configured to receive said connecting structure and having an open portion facing upward when said panel member is disposed vertically, comprising, in order:

assembling the panel members by connecting said adjoining edges with said connecting structure to create a wall at least partially blocking a view of the construction area from trafficked areas thereof;

disassembling the panel members by separating said adjoining edges at said connecting structure;

reassembling the panel members at a second construction area by connecting said adjoining edges with the same connecting structure employed in said assembling, at least partially blocking a view of the second construction area from trafficked areas thereof.

15. A method as in claim 14, wherein the first and second construction areas are in an indoor shopping center and the trafficked areas thereof are trafficked by customers of the shopping center.

16. A method as in claim 15, wherein the disassembled panel members are stored at a location local to the shopping center prior to reassembling.

17. A method as in claim 14, wherein the disassembling comprises storing the connecting structure within one or more panel members.

18. A modular temporary barrier system, comprising:

a plurality of panel members, said panel members having adjoining edges, each panel member comprising a foam core and exterior sheathing disposed on opposite sides thereof; and connecting structure associated with said panels and constructed and arranged to removably connect said adjoining edges of adjacent panel members to one another, wherein each panel member has an aperture formed therein that extends from one edge thereof to an opposite edge thereof, and wherein the connecting structure comprises a plurality of pegs, each peg being constructed and arranged to be at least partially inserted into apertures disposed in adjoining edges of adjacent panel members to removably connect said adjacent panel members to one another and wherein each peg has a length that is substantially the same size as a distance extending between the one edge and the opposite edge of each panel.

19. A modular temporary barrier system, comprising:

a plurality of panel members, said panel members having adjoining edges, each panel member comprising a foam core and exterior sheathing disposed on opposite sides thereof;

connecting structure associated with said panels and constructed and arranged to removably connect said adjoining edges of adjacent panel members to one another; and a top U-shaped portion being configured to receive said connecting structure and having an open portion facing upward when said panel member is disposed vertically.

* * * * *